US005951746A

United States Patent [19]

Treitz et al.

[11] Patent Number: 5,951,746

[45] Date of Patent: Sep. 14, 1999

[54] SUCTION DEVICE FOR CLEANING PURPOSES

[75] Inventors: Felix Treitz, Berglen; Peter Langer, Schwaikheim, both of Germany

[73] Assignee: Alfred Karcher GmbH & Co., Winnenden, Germany

[21] Appl. No.: 09/085,409

[22] Filed: May 27, 1998

Related U.S. Application Data

[63] Continuation of application No. PCT/EP95/04728, Nov. 30, 1995.

[51] Int. Cl.[6] ..... B01D 46/04

[52] U.S. Cl. ..... 96/403; 55/283; 55/288; 55/417; 55/420; 55/DIG. 3; 96/420; 96/424

[58] Field of Search ..... 55/288, 283, 302, 55/417, 420, DIG. 3; 96/403, 405, FOR 106, FOR 103, 420, 424, FOR 166, FOR 167

[56] References Cited

U.S. PATENT DOCUMENTS

| | | | |
|---|---|---|---|
| 3,325,979 | 6/1967 | Smith | 55/302 |
| 3,363,764 | 1/1968 | Whitaker | 55/288 |
| 3,396,516 | 8/1968 | Ballard | 55/302 |
| 3,431,709 | 3/1969 | Kawanami | 55/302 |
| 3,498,030 | 3/1970 | Wilki | 55/302 |
| 3,792,569 | 2/1974 | Carlson et al. | 55/288 |
| 3,868,237 | 2/1975 | Berz | 55/288 |
| 4,277,265 | 7/1981 | Leinfelt | 55/302 |
| 5,322,534 | 6/1994 | Kaiser | 55/288 |

FOREIGN PATENT DOCUMENTS

| | | | |
|---|---|---|---|
| 0 197 036 | 10/1985 | European Pat. Off. . | |
| 1 245 550 | 7/1967 | Germany . | |
| 2 106 058 | 9/1971 | Germany . | |
| 41 38 223 | 2/1993 | Germany . | |
| 644513 | 1/1979 | U.S.S.R. | 55/288 |
| WO 85/02528 | 6/1985 | WIPO . | |

*Primary Examiner*—Duane S. Smith
*Attorney, Agent, or Firm*—Barry R. Lipsitz; Ralph F. Hoppin

[57] ABSTRACT

In order to develop a suction device for cleaning purposes having a collecting container, which includes a closable suction inlet, a suction outlet and a filter disposed therebetween and is connected to a suction unit by a suction line emanating from the suction outlet, the suction line being closable by an outlet valve and an external air supply closable by a supply valve being disposed at the side of the filter remote from the suction inlet, in such a way that it facilitates filter dedusting, it is proposed that the suction device has a valve coupling unit, which links the closing of an inlet valve associated with the suction inlet and/or the opening of the supply valve to the closing of the outlet valve.

26 Claims, 4 Drawing Sheets

SUCTION DEVICE FOR CLEANING PURPOSES

This application is a continuation of International PCT Application No. PCT/EP95/04728 filed Nov. 30, 1995.

BACKGROUND OF THE INVENTION

The invention relates to a suction device for cleaning purposes having a collecting container, which comprises a closable suction inlet, a suction outlet and a filter disposed therebetween and is connected to a suction unit by a suction line emanating from the suction outlet, the suction line being closable by means of an outlet valve and an external air supply closable by means of a supply valve being disposed at the side of the filter remote from the suction inlet.

Such devices are used, for example, as industrial dust extractors. After a certain operating period the filter becomes extremely dirty, so that it becomes necessary to dedust the filter. In simple devices, this is effected by knocking the dust off the filter, e.g. with the aid of a mechanical scraper.

EP-B1-0 197 036 proposes the use, in a dust extractor, of two separate filters as well as a device for reversing the air circulation in a respective one of the filters. For said purpose, the suction line is closed and the air drawn in through the one filter flows through the other filter in reverse flow direction so that a dedusting of said filter is effected. This requires a construction of an elaborate design as well as the provision of two separate filters.

In DE-C1-41 38 223 it is proposed to effect the filter dedusting in a plurality of stages, during each of which one sub-region of the filter is covered by an external air supply so that said filter sub-region is swept in reverse flow direction and hence cleaned. Cleaning of the entire filter is extremely time-consuming and, in addition, the external air supply directable onto the individual sub-regions requires a considerable constructional outlay.

It is also known (DE-OS 21 06 058) for the area between filter and suction unit to be connected by a valve opening to outside air and for the valve opening to be alternately opened and closed during simultaneous operation of the suction unit. The filter is clamped onto a rigid supporting frame and as a result of the pressure variations associated with opening and closing of the valve opening the filter is knocked against its supporting frame and dust particles adhering to the filter are knocked off. Knocking-off however effects only an inadequate dedusting of the filter as the filter is not sufficiently swept in reverse flow direction.

In DE-AS 12 45 550 it is proposed to achieve filter dedusting by first closing the suction inlet while the suction unit is in operation in order to produce a partial vacuum in the collecting container. Then the suction unit is switched off and/or the outlet valve closed. A supply valve is then opened and, by means of an external air supply, outside air is admitted into the area between filter and outlet valve. The mode of operation is therefore very complicated and susceptible to operating errors and, in addition, adequate filter dedusting is also not always achieved.

U.S. Pat. No. 4,277,265 describes a suction device which uses a bag-shaped filter, which is pressed together during dedusting of the filter. For said purpose, an inlet valve and an external air supply closable by means of a supply valve are provided in a collecting container which accommodates the filter, the inlet valve being mechanically coupled to the supply valve. When the inlet valve is closed, the supply valve is simultaneously opened and external air flows at the side of the collecting container remote from the filter into the collecting container. The bag-shaped filter is therefore pressed together and the air remaining in the filter upon closing of the inlet valve may escape through the suction outlet. With said suction device, it is necessary for the suction unit to be flow-connected to the collecting container during filter dedusting, i.e. when the supply valve is opened and external air flows in. Filter dedusting is therefore associated with a high loading of the suction unit.

SUMMARY OF THE INVENTION

The object of the invention is to improve a suction device of the type described in such a way that it facilitates filter dedusting.

In a suction device of the type described initially, said object is achieved according to the invention in that the suction device comprises a valve coupling unit, which links the closing of an inlet valve associated with the suction inlet and/or the opening of the supply valve to the closing of the outlet valve.

The valve coupling unit facilitates operation of the suction device during filter dedusting. Filter dedusting is effected in that the filter is swept in reverse flow direction by external air supplied to the filter via the external air supply. To prevent external air from being sucked into the suction unit, the connection between collecting container and suction unit has to be interrupted by closing of the outlet valve. The suction inlet moreover has to be closed so that the external air is sucked into the collecting container on account of the partial vacuum prevailing in the collecting container. Closing of the suction inlet may be effected by the user covering the suction inlet, e.g. with his hand, or by the user closing an inlet valve optionally associated with the suction inlet. In the refinement of the suction device according to the invention, the valves are at least partially coupled to one another by the valve coupling unit, thereby facilitating operation of the suction device and preventing operating errors.

Provided that the suction device comprises an inlet valve, the latter may according to the present invention be coupled by the valve coupling unit to the outlet valve in such a way that the one valve, e.g. the inlet valve, is automatically closed when the user closes the other valve, e.g. the outlet valve. He then only has to open the supply valve to effect filter dedusting.

The supply valve may also be coupled by the valve coupling unit to the outlet valve so that, for example, the external air supply is automatically opened when the outlet valve moves into its closed position or, conversely, the outlet valve closes when the external air supply is opened. Such a coupling may exist even when no inlet valve is provided and the user instead covers the suction inlet, e.g. with his hand.

With both coupling of the inlet valve to the outlet valve and coupling of the supply valve to the outlet valve, the suction device is made easier to operate during filter dedusting. Coupling of the supply valve to the outlet valve moreover prevents the outlet valve from incorrectly being closed only after the supply valve has been opened.

Operation which is particularly easy and precludes operating errors results when the suction device comprises an inlet valve and when both the latter and the supply valve are coupled by the valve coupling unit to the outlet valve. The user then need operate only one valve. Opening and closing of the other valves is then effected automatically.

The partial vacuum developing in the collecting container on account of the suction unit is as a rule reduced because of leakages in the collecting container after only a relatively short time when the outlet valve is closed and the collecting container is therefore isolated from the suction unit. For an effective filter dedusting it is therefore advantageous when the valve coupling unit opens the supply valve at the latest with a time delay of around 3 seconds after closing of the outlet valve. When the supply valve is opened within said interval, the partial vacuum prevailing in the collecting container is sufficient to effect thorough filter dedusting even given manufacture-related, customary leakages of the collecting container.

Particularly effective filter dedusting may be achieved when the valve coupling unit opens the supply valve substantially simultaneously with the closing of the outlet valve. In said case, even given leakages in the collecting container, the entire partial vacuum which has developed in the collecting container prior to interruption of the connection between collecting container and suction unit is utilized for filter dedusting.

The coupling between inlet valve and outlet valve may be effected in various ways, e.g. mechanically, electromagnetically, hydraulically or pneumatically.

The coupling of outlet valve and supply valve may likewise be designed in a variety of ways, e.g. an electromagnetic or hydraulic coupling may be provided. In a refinement of the invention which is inexpensive to manufacture, it is provided that the outlet valve and supply valve are mechanically coupled.

In a particularly preferred refinement of the invention, it is provided that the outlet valve and supply valve are pneumatically coupled.

It is advantageous when a pressure sensor controlling the outlet valve is disposed at the external air supply. The pressure increase in the external air supply which arises with opening of the supply valve is registered by the pressure sensor which, because of the pressure increase, closes the outlet valve.

In a constructionally simple refinement, it is provided that the pressure sensor takes the form of a sliding element, which is supported displaceably at the external air supply and is displaceable in dependence upon the pressure prevailing in the external air supply. When the supply valve is opened, the pressure in the external air supply consequently rises and the sliding element is displaced. As a result, the outlet valve is closed.

The external air supply may comprise a supply line, which opens out into the suction line.

In an advantageous refinement, it is provided that the supply valve comprises a valve body, which is movable into its open position counter to the action of a spring. It is thereby guaranteed that, in operating phases during which no filter dedusting is required, the valve body of the supply valve is held in its closed position by the spring action.

In a preferred refinement, it is provided that the valve body of the supply valve is displaceable along the supply line and in its open position unblocks an opening, which is disposed in the supply line and which it overlaps in its closed position.

It is advantageous when the outlet valve comprises a valve body, which in its closed position engages into the suction outlet and in the open position unblocks the suction outlet. During filter dedusting the suction inlet is closed, after opening of the supply valve external air is sucked in on account of the partial vacuum prevailing in the collecting container. When the valve body of the outlet valve in its closed position engages into the suction outlet, it is thereby ensured that no dust or dirt escapes out of the collecting container during filter dedusting.

To enable as large a dirt-retaining space in the collecting container as possible, in an advantageous refinement of the invention it is provided that the filter is disposed adjacent to the suction outlet. A further reason why this is advantageous is that the filter, upon engagement of the valve body of the outlet valve into the suction outlet, may therefore be mechanically shaken so that, in addition to the cleaning action caused by the flow of external air in reverse flow direction through the filter, dust is mechanically knocked off the filter.

A constructionally simple refinement is achieved when the valve body of the outlet valve is displaceable along the supply line.

In a preferred refinement, it is provided that the valve body of the outlet valve is spring-loaded in the direction of its open position. It is thereby ensured that the outlet valve is situated in open position in the operating phases of the suction device during which no dedusting is required.

In a particularly advantageous refinement, it is provided that the valve body of the outlet valve is displaceable along an end portion of the supply line engaging into the suction line and is held in its open position by the air stream flowing through the suction outlet. During normal operation of the suction device, air laden with dirt and dust particles is sucked by the suction unit into the collecting container. The air then flows through the filter and passes through the suction outlet into the suction line. At the suction outlet there is therefore development of an air flow which holds the valve body of the outlet valve in its open position in the operating phases during which no filter dedusting is required. Additional elements for holding the valve body of the outlet valve in its open position are therefore not required.

In a constructionally particularly simple and rugged refinement of the invention, it is provided that the valve body of the supply valve is integrally connected to the valve body of the outlet valve. The resultant effect is a mechanical coupling of the two valves, with a displacement of the one valve body leading to a displacement of the other valve body on account of the integral construction.

The inlet valve may be disposed at the suction inlet.

A particularly advantageous construction of a suction device arises when the suction inlet takes the form of a suction connection opening into the collecting container and the inlet valve takes the form of a slide, which in its closed position engages through the suction connection.

The suction inlet is connected by a suction tube to a suction nozzle of the suction device. It is advantageous when the inlet valve is disposed on the suction nozzle because then the inlet valve is particularly easily accessible to the user, who may therefore operate it easily and comfortably.

Up till now, the manner in which the supply valve may be operated has not been described. In a constructionally simple refinement, it is provided that the supply valve is operable mechanically, e.g. by hand.

In a particularly preferred refinement of the suction device according to the invention, it is provided that the suction device comprises a control unit, which opens the supply valve after closing of the suction inlet. Operation of the suction device during filter dedusting is therefore effected in that the suction inlet is closed. opening of the supply valve is then effected automatically by the provided control unit and closing of the outlet valve is effected by the valve coupling unit.

Control may be effected, for example, in a time-dependent manner so that the control unit opens the supply valve at the end of a defined time interval after closing of the suction inlet. During said time interval an increased partial vacuum is generated in the collecting container as a result of operation of the suction unit, at the end of the time interval, e.g. after roughly at most a seconds have elapsed, the supply valve is opened automatically by the control unit.

Particularly effective filter dedusting is guaranteed when the control unit opens the supply valve upon attainment of a defined partial vacuum in the collecting container between suction inlet and filter. The deciding factor for opening of the supply valve is therefore the partial vacuum prevailing in the collecting container in front of the filter. An increased partial vacuum is advantageous for a particularly effective sweeping of the filter in reverse flow direction with external air. The time taken, after closing of the suction inlet, for said increased partial vacuum to arise in the collecting container varies depending on how dirty the filter is. If the filter is extremely dirty, the suction effect produced by the suction unit in the collecting container is reduced so that it takes a longer time, after closing of the suction inlet, to achieve the increased partial vacuum required for particularly effective filter dedusting. If, on the other hand, the filter is only slightly dirty, it takes only a short time after closing of the suction inlet to achieve the desired partial vacuum in the collecting container.

In a particularly preferred refinement, it is provided that the control unit comprises a control piston, which is displaceable in dependence upon the pressure prevailing in the collecting container between suction inlet and filter. The control piston therefore acts as a pressure sensor, which detects the pressure prevailing in the collecting container.

Control of the supply valve may be effected in that the valve body of the supply valve is movable into its open position in dependence upon the position of the control piston. When the suction inlet is closed, then the pressure in the collecting container is lowered and the control piston is displaced. Said displacement serves as a signal for the valve body of the supply valve, which is moved into its open position when the displacement of the control piston in accordance with the partial vacuum prevailing in the collecting container has reached a desired extent.

In a particularly preferred refinement of the suction device according to the invention, it is provided that the valve body of the supply valve is integrally connected to the control piston. This enables a refinement, which is constructionally particularly simple and inexpensive to manufacture and in which the supply valve is opened in dependence upon the partial vacuum prevailing in the collecting container.

The following description of two preferred embodiments of the invention is used, in conjunction with the drawings, to provide a more detailed explanation.

DETAILED DESCRIPTION OF THE INVENTION

Figure 1:
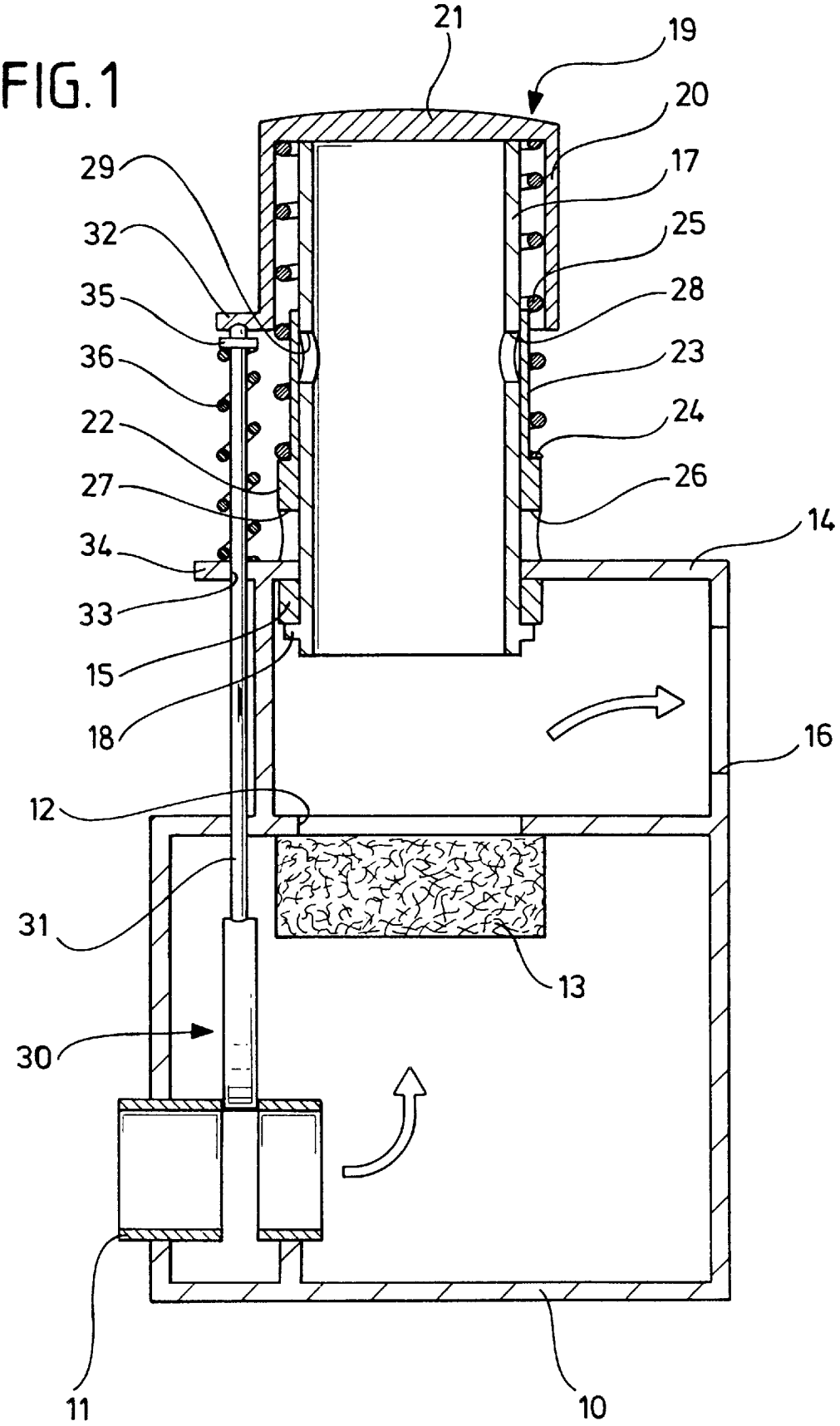
FIG. 1: a diagrammatic sectional view of a collecting container with manually operated filter dedusting in suction mode.
Figure 2:
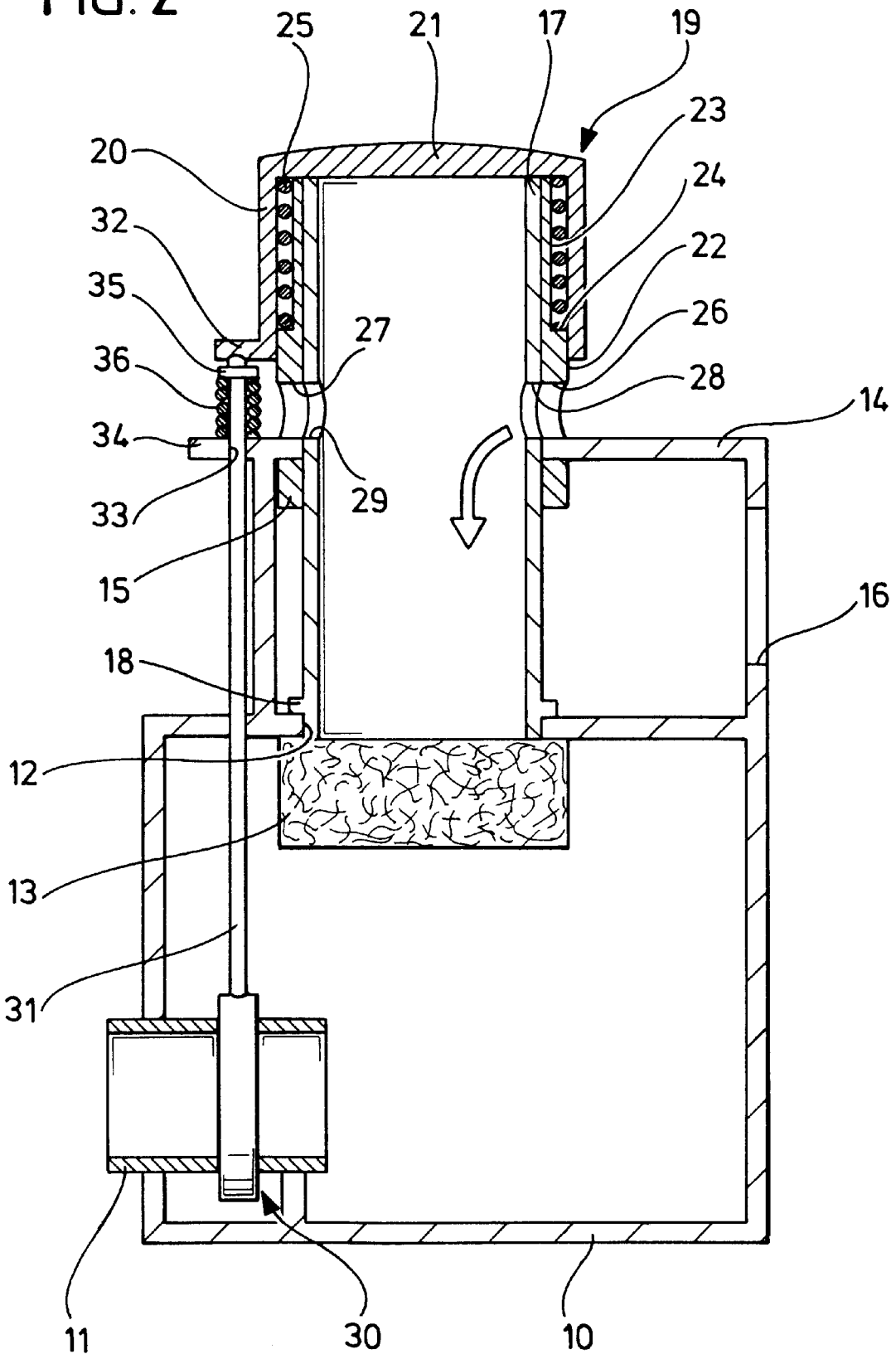
FIG. 2: a sectional view corresponding to FIG. 1 during cleaning of the filter.

FIGS. 1 and 2 show a collecting container 10 having a suction inlet in the form of an inlet connection 11, which engages into the collecting container, and a suction outlet 12, which is disposed at the top of the collecting container 10 and covered inside the collecting container 10 by a filter 13. The suction outlet 12 forms a connection between the collecting container 10 and a suction line 14 integrally connected thereto and disposed at the top of said collecting container. A supply line 15 engages, opposite the suction outlet 12, into said suction line. The suction line 14 has a connection opening 16, to which may be connected a suction unit which is not shown in the drawings. A suction tube, which is likewise not shown in the drawings, may be placed onto the inlet connection so that, as a result of the suction action of the suction unit, air laden with dirt and dust may be sucked through the suction tube and the inlet connection into the collecting container 10. The air then flows through the filter 13 and the suction line 14 towards the connection opening 16, in the manner illustrated by double arrows in FIG. 1.

The supply line 15 is penetrated by a pipe 17, which is displaceably supported against the inside of the supply line 15 and has at its outside, on its end portion engaging into the suction line 14, a flange 18. The end portion of the pipe 17 remote from the suction line 14 is encased by a sleeve 19, a sleeve jacket 20 embracing the end portion of the pipe 17 and a sleeve cover 21 covering the pipe 17.

The outside of the supply line 15 is stepped so that the supply line 15 in a front portion 22 adjacent to the suction line 14 has a greater wall thickness than in a rear portion 23 remote from the suction line 14. Front and rear portions 22 and 23 of the supply line 15 are separated from one another by a step 24. Supported on the step 24 is a compression spring 25 in the form of a helical spring, which extends between the sleeve jacket 20 and the end portion of the pipe 17 remote from the suction line 14 and comes to rest against the sleeve cover 21. The sleeve cover 21 is fastened to the end of the pipe 17 remote from the suction line 14 so that the compression spring 25 via the sleeve cover 21 presses the pipe 17 out of the suction line 14 until the flange 18 of the pipe 17 abuts the end of the supply line 15 disposed in the suction line 14.

The supply line 15 has in its front portion 22 two diametrically opposed openings 26, 27 which, in the outwardly pressed position of the pipe 17 illustrated in FIG. 1, are covered by said pipe. Introduced into the pipe 17 and spaced in longitudinal direction of the pipe apart from the openings 26 and 27 of the supply line 15 are also two diametrically opposed openings 28 and 29 which, in the outwardly pressed position of the pipe 17 as illustrated in FIG. 1, are covered by the rear portion 23 of the supply line 15.

The inlet connection 11 is closable by means of a slide valve 30, the latter being mechanically connected by a valve stem 31 to the sleeve 19 in that the end of the valve stem 31 remote from the slide valve abuts a lug 32 disposed on the sleeve jacket 20. The valve stem 31 penetrates a bore 33 in a valve guide 34 integrally connected to the suction line 14 and has, on its end portion adjacent to the lug 32, a circumferential bead 35. Clamped between the valve guide 34 and the bead 35 is a helical spring 36, which is penetrated by the valve stem 31 and acts upon the valve stem 31 with a spring force directed towards the sleeve 31.

During the suction mode illustrated in FIG. 1, the pipe 17 is, as explained, pressed out of the suction line 14 so that the openings 26 to 29 are covered and no external air may penetrate into the suction line 14 or into the collecting container 10. At the same time, the slide valve 30 is pressed out of the inlet connection 11 by the helical spring 36 so that air laden with dirt and dust particles may be sucked into the collecting chamber 10.

When the sleeve 19 is pressed counter to the spring action of the compression spring 25 and the helical spring 36 in the direction of the suction line 14 in the manner illustrated in FIG. 2, on the one hand the inlet connection 11 is closed by means of the slide valve 30 and on the other hand the pipe 17 penetrates the suction line 14 and engages with its end portion disposed in the suction line 14 into the suction outlet 12 as far as the stop formed by the flange 18 allows. At the same time, the openings 28 and 29 of the pipe 17 are aligned with the openings 26 and 27 of the supply line 15, with the result that external air may pass through the openings 26 to 29 into the supply line 15 and the pipe 17 and, on account of the partial vacuum caused by the preceding suction mode in the collecting container 10, is sucked in reverse flow direction through the filter 13 into the collecting container 10. As a result, dust and dirt particles are effectively removed from the filter 13. Since the pipe 17 during the cleaning of the filter illustrated in FIG. 2 penetrates the suction line 14, the connection between the suction outlet 12 and the suction unit (not shown in the drawings) is simultaneously interrupted. The openings 26 and 27 in the supply line 15 together with the openings 28 and 29 in the pipe 17 therefore form a supply valve, simultaneously effecting y valve simultaneously effecting a closing of the outlet valve in the form of the end portion of the pipe 17 which engages into the suction outlet 12.

After operation of the sleeve 19, the latter on account of the spring action of the compression spring 25 and the helical spring 36 automatically returns into its original position, in which the supply line is closed, so that the suction mode may be continued.

Figure 3:
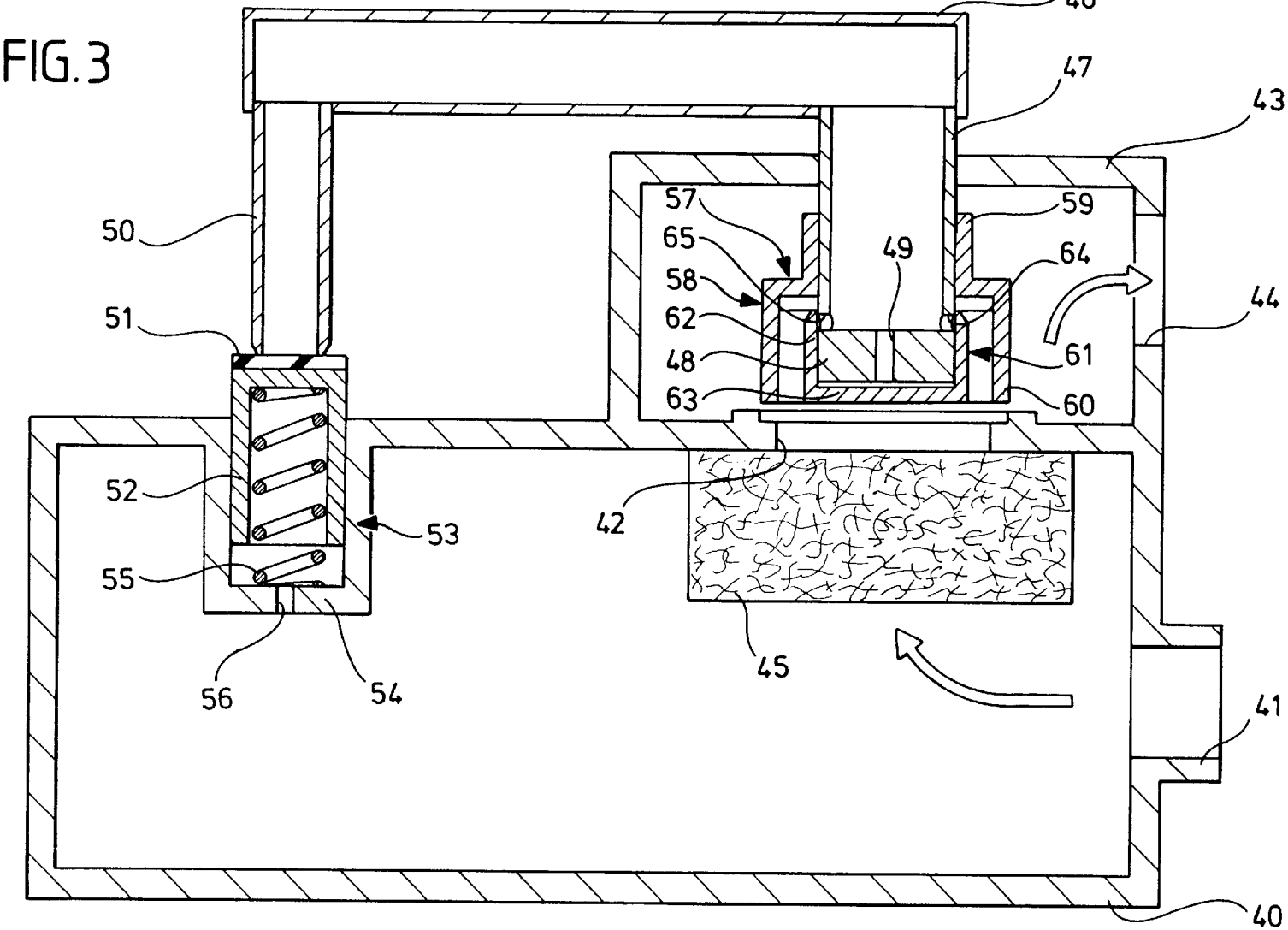
FIG. 3: a diagrammatic sectional view of a collecting container with automatic filter dedusting in suction mode
Figure 4:
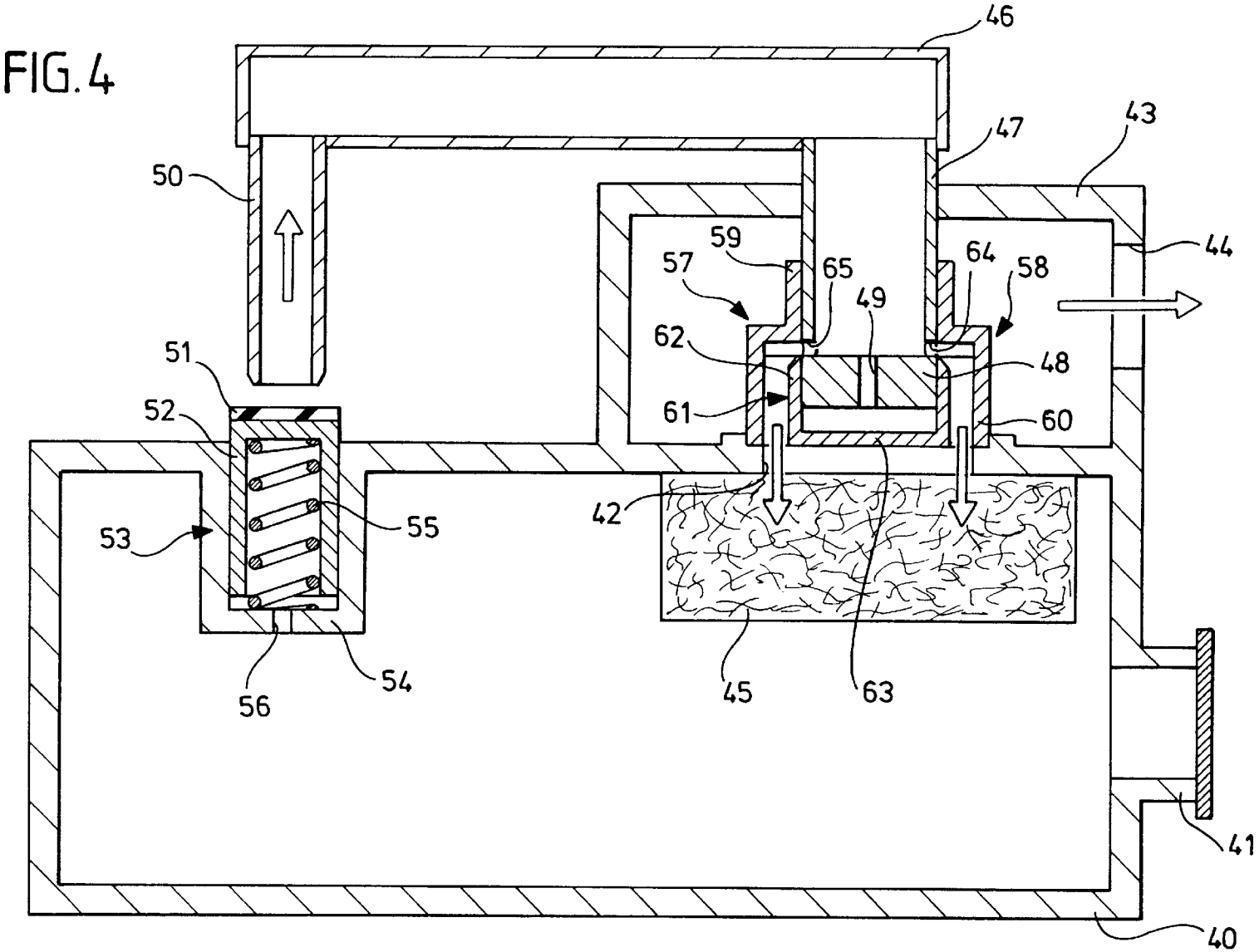
FIG. 4: a sectional view corresponding to FIG. 3 during cleaning of the filter.

A second embodiment of the invention is illustrated in FIGS. 3 and 4. They show a collecting container 40 having a suction inlet 41, onto which a suction tube (not shown in the drawings) may be placed, and having a suction outlet 42, which is disposed at the top of the collecting container 40 and forms a connection between the collecting container 40 and a suction line 43 integrally connected to the top of the collecting container. Said suction line has a connection opening 44, to which may be connected a suction unit which is not shown in the drawings. The suction outlet 42 is covered inside the collecting container 40 by a filter 45, through which air laden with dirt and dust particles is drawn on account of the suction action of the suction unit. The air drawn in then flows through the suction outlet 42 and the suction line 43 in the manner indicated by double arrows in FIG. 3.

A U-shaped supply line 46 engages with a first limb 47, opposite the suction outlet 42, into the suction line 43 and is covered by a closing body 48 having a central through-bore 49.

The opening of a second limb 50 of the U-shaped supply line 46 is covered by a valve plate 51. The valve plate 51 is fastened to a control piston 52, which is held displaceably in a guiding cylinder 53 integrally formed with the collecting container 40, a compression spring 55 being disposed between a base 54 of the guiding cylinder 53 and the control piston 52 and acting upon the control piston 52 and hence upon the valve plate 51 with a spring force directed towards the second limb 50 of the supply line 46. A bore 56 is disposed in the base 54 of the guiding cylinder 53 and forms a connection between the collecting container 40 and the control piston 52 so that the latter is acted upon at its side remote from the valve plate 51 by the partial vacuum prevailing in the collecting container 40.

A valve body 57 is held displaceably on the first limb 47 of the supply line 46 which engages into the suction line 43. Said valve body comprises a stepped pipe 58, which has a rear pipe portion 59 resting against the outside of the first limb 47 and a front pipe portion 60 with an outside diameter corresponding to the inside diameter of the suction outlet 42, as well as a sliding sleeve 61, which is integrally connected to the pipe 58 and comprises a jacket 62 surrounding the end portion of the first limb 47 adjacent to the suction outlet 42 and a base 63 covering the closing body 48 of the first limb 47. Inserted into the first limb 47 of the supply line 46 and lying adjacent to the closing body 48 are two diametrically opposed openings 64 and 65 which, in the position of the valve body 57 shown in FIG. 3, are in fact covered, but not tightly closed, by the jacket 62.

The valve body 57 is displaceable between the retracted position shown in FIG. 3, in which the front pipe portion 60 unblocks the suction outlet 42 and the jacket 62 of the sliding sleeve 61 covers the openings 64 and 65, and an advanced position shown in FIG. 4, in which the front pipe portion 60 engages into the suction outlet 42 and the jacket 62 of the sliding sleeve 61 unblocks the openings 64 and 65.

When the suction outlet 41 is open, as shown in FIG. 3, the air drawn in flows through the suction outlet 42 and past the base 63 of the sliding sleeve 61 and the front portion 60 of the pipe 48, and because of the air flow the valve body 57 supported displaceably on the first limb 47 is held in its retracted position. The valve body 57 adopts said position during suction mode.

During suction mode, a certain partial vacuum prevails in the collecting container 40 in the region between suction inlet 41 and filter 45 but is insufficient to move the control piston 52 counter to the action of the compression spring 55, the spring constant of the compression spring 55 rather being selected in such a way that during suction mode the control piston 52 and hence the valve plate 51 are pressed against the end of the second limb 50 of the supply line 46, with the result that the latter is tightly closed and no external air may penetrate into the supply line 46.

When the suction inlet 41 is closed, as shown in FIG. 4, the suction action of the suction unit (not shown in the drawings) causes the partial vacuum in the collecting container 40 to increase until it reaches a value, at which the control piston 52 is displaced counter to the action of the compression spring 55 towards the base 54 so that the valve plate 51 lifts off the second limb 50 of the supply line 46. The supply line 46 is therefore opened and there passes into the supply line 46 external air, which was previously in suction mode pumped out through leakages disposed in the region of the valve body 57 since the valve body 57 does not tightly close the first limb 47 of the supply line 46. As a result of the pressure increase effected by the admission of external air into the supply line 46, the base 63 of the sliding sleeve 61 and the front pipe portion 60—integrally connected to said base—of the pipe 58 of the valve body 57 are pressed suddenly down towards the suction outlet 42. The through-bore 49 forms, for said purpose, the necessary connection between the first limb 47 and the base 63. The covering of the suction outlet 42 by the pipe 58 therefore interrupts the connection between the suction outlet 42 and the suction line 43 and at the same time via the openings 64 and 65 in the first limb 47 of the supply line 46 external air may flow, counter to the flow direction prevailing in suction mode, through the suction outlet 42 and the filter 45 into the collecting container 40. This is illustrated by the double arrows in FIG. 4.

The filter 45 swept in reverse flow direction by external air is effectively cleaned of dust and dirt particles, the cleaning being assisted by the knocking-off effect of the valve body 57, which effect is produced by the fact that the valve body owing to the sudden pressure increase in the supply line 46 strikes against the suction outlet 42 and in so doing mechanically shakes the filter 45. Sweeping of the filter 45 in reverse flow direction is effected until the pressure in the collecting container 40 has increased to such an extent that the spring action of the compression spring 55 is sufficient to displace the control piston 52 and hence the valve plate 51 towards the second limb 50, with the result that the valve plate 51 lies sealingly against the second limb 50 and hence interrupts the external air supply. As a result, the base 63 of the sliding sleeve 61 is no longer acted upon by a pressure in the direction of the suction outlet 42 so that the valve body 57, owing to the partial vacuum in the suction line 43 which throughout filter dedusting is evacuated in the same manner as during suction mode by the suction unit, lifts back off the suction outlet 42 again and it is again possible for an air flow to develop, which holds the valve body 57 in its retracted position. Suction mode may therefore continue.

What is claimed is:

1. A suction device for cleaning purposes having a collecting container, said collecting container comprising:

a closable suction inlet, a suction outlet, a filter disposed between said inlet and outlet, said collecting container being connected to a suction unit by a suction line emanating from the suction outlet, said suction line being closable by means of an outlet valve, and an external air supply closable by means of a supply valve being disposed at a side of the filter remote from the suction inlet, wherein the suction device comprises a valve coupling unit which links at least one of: (a) the closing of an inlet valve associated with the suction inlet, and (b) the opening of the supply valve, to the closing of the outlet valve.

2. A suction device according to claim 1, wherein the valve coupling unit opens the supply valve at the latest with a time delay of approximately three seconds after closing of the outlet valve.

3. A suction device according to claim 1, wherein the valve coupling unit opens the supply valve substantially simultaneously with the closing of the outlet valve.

4. A suction device according to claim 1, wherein the outlet valve and the supply valve are mechanically coupled.

5. A suction device according to claim 1, wherein the outlet valve and the supply valve are pneumatically coupled.

6. A suction device according to claim 1, wherein a pressure sensor which controls the outlet valve is disposed on the external air supply.

7. A suction device according to claim 6, wherein the pressure sensor comprises a sliding element supported displaceably on the external air supply and is displaceable in dependence upon the pressure prevailing in the external air supply.

8. A suction device according to claim 1, wherein the external air supply comprises a supply line which opens out into the suction line.

9. A suction device according to claim 1, wherein the supply valve comprises a valve body which is movable into its open position counter to the action of a spring.

10. A suction device according to claim 9, wherein the valve body of the supply valve is displaceable along the supply line to unblock an opening disposed in the supply line in an open position and to cover the opening disposed in the supply line in a closed position.

11. A suction device according to claim 1, wherein the outlet valve comprises a valve body which in its closed position engages into the suction outlet and in its open position unblocks the suction outlet.

12. A suction device according to claim 11, wherein the valve body of the outlet valve is displaceable along the supply line.

13. A suction device according to claim 1, wherein a valve body of the outlet valve is displaceable along the supply line.

14. A suction device according to claim 1, wherein a valve body of the outlet valve is spring-loaded in the direction of its open position.

15. A suction device according to claim 12, wherein the valve body of the outlet valve is spring-loaded in the direction of its open position.

16. A suction device according to claim 1, wherein a valve body of the outlet valve is displaceable along an end portion of the supply line engaging into the suction line and is held in its open position by the air stream flowing through the suction outlet.

17. A suction device according to claim 1, wherein a valve body of the supply valve is integrally connected to a valve body of the outlet valve.

18. A suction device according to claim 15, wherein the valve body of the supply valve is integrally connected to a valve body of the outlet valve.

19. A suction device according to claim 1, wherein the supply valve is mechanically operable.

20. A suction device according to claim 18, wherein the supply valve is mechanically operable.

21. A suction device according to claim 1, wherein the suction device comprises a control unit, which opens the supply valve after closing of the suction inlet.

22. A suction device according to claim 21, wherein the control unit opens the supply valve at the end of a defined time interval after closing of the suction inlet.

23. A suction device according to claim 21, wherein the control unit opens the supply valve upon attainment of a defined partial vacuum in the collecting container between said suction inlet and filter.

24. A suction device according to claim 23, wherein the control unit comprises a control piston which is displaceable in dependence upon the pressure prevailing in the collecting container between suction inlet and filter.

25. A suction device according to claim 24, wherein the valve body of the supply valve is movable into its open position in dependence upon the position of the control piston.

26. A suction device according to claim 25, wherein the valve body of the supply valve is integrally connected to the control piston.

* * * * *